US006260215B1

(12) United States Patent
Miller

(10) Patent No.: US 6,260,215 B1
(45) Date of Patent: Jul. 17, 2001

(54) FOUL AIR REMOVAL APPARATUS FOR A TOILET BOWL

(76) Inventor: Max Miller, 41 S. Vinedo Ave., #8, Pasadena, CA (US) 91107

( * ) Notice: Subject to any disclaimer, the term of this patent is extended or adjusted under 35 U.S.C. 154(b) by 0 days.

(21) Appl. No.: 09/552,420

(22) Filed: Apr. 19, 2000

(51) Int. Cl.[7] ..... E03D 9/04
(52) U.S. Cl. ..... 4/217
(58) Field of Search ..... 4/213, 217

(56) References Cited

U.S. PATENT DOCUMENTS 4,251,888 * 2/1981 Turner ..... 4/217 X
5,345,617 * 9/1994 Jahner et al. ..... 4/217
5,454,122 * 10/1995 Bergeron ..... 4/213 X

FOREIGN PATENT DOCUMENTS

9106717 * 5/1991 (WO) ..... 4/217

* cited by examiner

*Primary Examiner*—Charles E. Phillips
(74) *Attorney, Agent, or Firm*—George J. Netter

(57) ABSTRACT

A toilet (20) has an upper part (28) and lower part (30) joined together. A foul air unit (22) mounted to the rear of the seat is interconnected via a flexible tube (16) with a filtration unit (12) mounted conveniently adjacent. A fresh air outlet (24) mounted on the seat front interconnects with the unit (12) via a flexible tube (18). A further version exits pressurized foul air to the exterior of the toilet room without filtering.

2 Claims, 4 Drawing Sheets

FOUL AIR REMOVAL APPARATUS FOR A TOILET BOWL

BACKGROUND

Background of the Invention

The present invention relates generally to foul air removal apparatus for a toilet, and, more particularly, to such apparatus including foul air inlet and fresh air outlet means incorporated into the toilet seat.

SUMMARY

In accordance with the practice of the present invention, foul air inlet means are connected to a toilet seat adjacent its rear side (i.e., where rotatably connected to the toilet bowl) and extend downwardly somewhat into the bowl above the water. Similarly, a filtered air outlet means are secured to the front underside of the seat and extend downwardly into the bowl above the bowl water. A first hollow tubular member is incorporated within the seat body having one end connected to the foul air inlet means and its other end exiting adjacent one part of the hardware that rotatably interconnects the seat to the bowl. A second tubular member incorporated within the toilet seat body extends from the filtered air outlet means to an exit point adjacent a second hardware part for rotatably mounting the seat to the bowl.

An air filtration unit is located conveniently adjacent the toilet seat (e.g., resting on the toilet water tank behind the seat or mounted onto an adjacent wall) and includes a first flexible tube interconnecting the unit inlet with the foul air seat opening and a second flexible tube interconnecting the unit filtered air outlet to the seat opening for the filtered air outlet means. Also, an electrically powered apparatus for moving air through the unit is incorporated within the unit.

The two flexible tubes are interconnected by individual fittings each of which includes an opening for providing communication with a respective tubular member exit opening.

A further feature is the location of a pushbutton electrical switch on the upper surface of the toilet seat which is actuated when someone sits on the seat to energize the filtration unit and remove foul air for filtration.

In a further embodiment of the invention, flexible tubes interconnect the seat to an electric fan air pressurizing means which both exits the foul air from the bathroom via a wall opening and provides fresh air to the seat.

DESCRIPTION OF A PREFERRED EMBODIMENT

Figure 1:
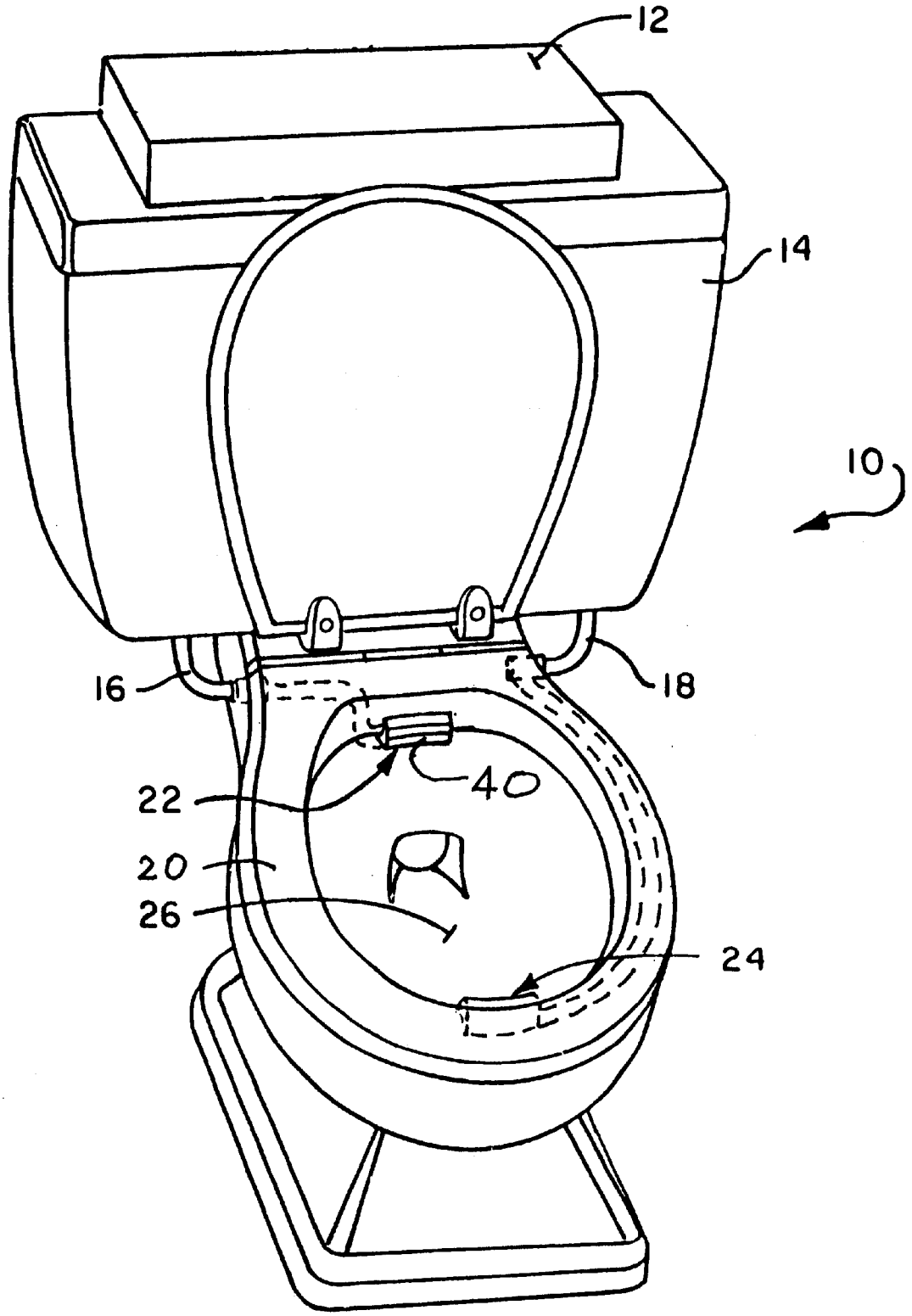
FIG. 1 is a perspective view of the invention shown mounted onto a typical toilet apparatus.

With reference now to the drawing and particularly FIG. 1, there is shown an embodiment 10 of the invention, including, in its major parts, an air filtration unit 12 positioned on the upper surface of a typical toilet water tank 14 interconnected by first and second flexible tubes 16 and 18 with a specially constructed toilet seat 20 to be described. In general operation, the filtration unit 12 when electrically energized draws foul air from the inlet means 22 on the seat via a first flexible tube 16 into the air filtration unit where the air is deodorized and then returned to the fresh air outlet means 24 to exit into the toilet bowl 26 between the seat and the bowl water.

Figure 2:
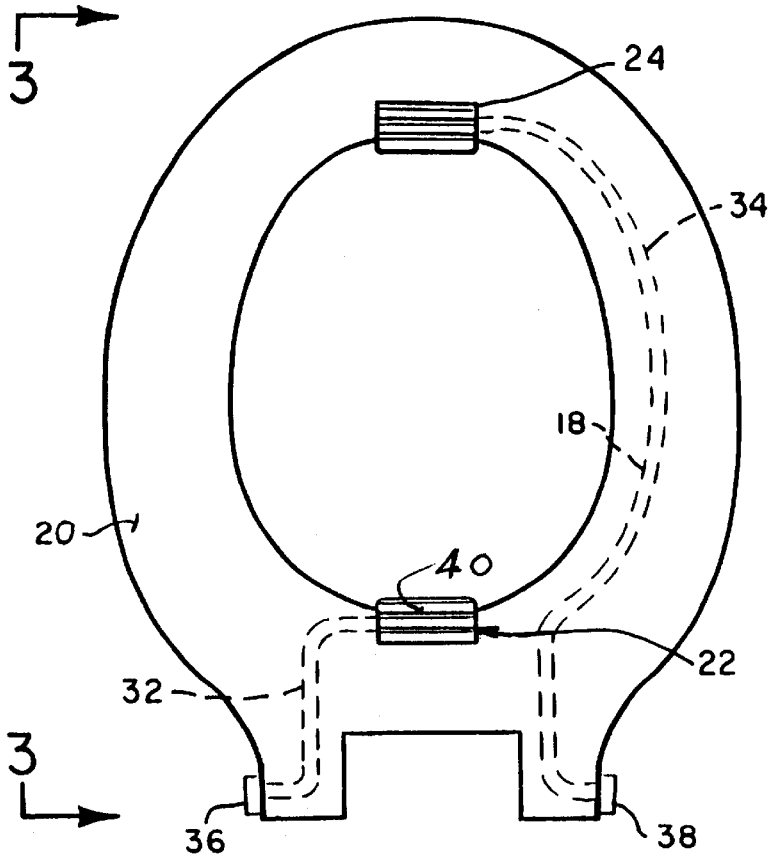
FIG. 2 is a bottom plan view of a toilet seat modified in accordance with the present invention.
Figure 3:
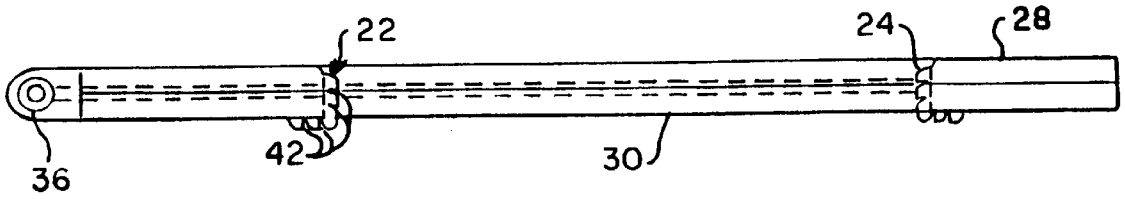
FIG. 3 is a side elevational view taken along the line 3—3 of FIG. 2.

Turning now to FIGS. 2 and 3, the toilet seat 20 is seen to include an upper seat part 28 and lower seat part 30 with aligned facing grooves which enclose first and second tubes 32 and 34 when the seat parts are unitarily secured together (e.g., by cementitious material). More particularly, the first tube 32 has one end connected to the foul air inlet means 22 and its other end terminating at a first rotatable seat mounting means 36. Similarly, the second tube 34 has one end interconnected with the fresh air outlet means 24 and its other end connected to a second rotatable seat mounting means 38. As the name implies, the mounting means 36 and 38 secure the seat to the toilet bowl 26 such that the seat can be rotated from a generally horizontal position resting on the top surface of the bowl 26 to an upright position uncovering the bowl and leaning against the water tank 14, as is commonly required for a toilet seat.

The inlet and outlet means 22 and 24 can be identically constructed, and, therefore, only means 22 will be described in detail. In particular, means 22 preferably includes a body member 40 with a plurality of slot openings 42, which body member is mounted onto the seat and extends over and spaced from an open end of the first tube 32. The means 24 similarly is mounted to the seat and extends over the open end of the second tube 34 adjacent the front of the seat.

As shown best in FIG. 2, when the seat is in raised condition the slots face downwardly, which prevents any accumulation of water from flowing into tubes 32 and 34 and thus into the air filtration unit to be described.

The air filtration unit 12 is preferably situated on the top surface of the water tank 14 with the flexible tubes 16 and 18 extending preferably down behind the water tank for interconnection to the mounting means 36 and 38. The filtration unit 12 typically includes an electric fan for drawing foul air into the unit and through a filtering material (e.g., powdered charcoal, baking soda, molecular sieves) to be emitted as fresh air into the toilet bowl via the outlet means 24.

Figure 4:
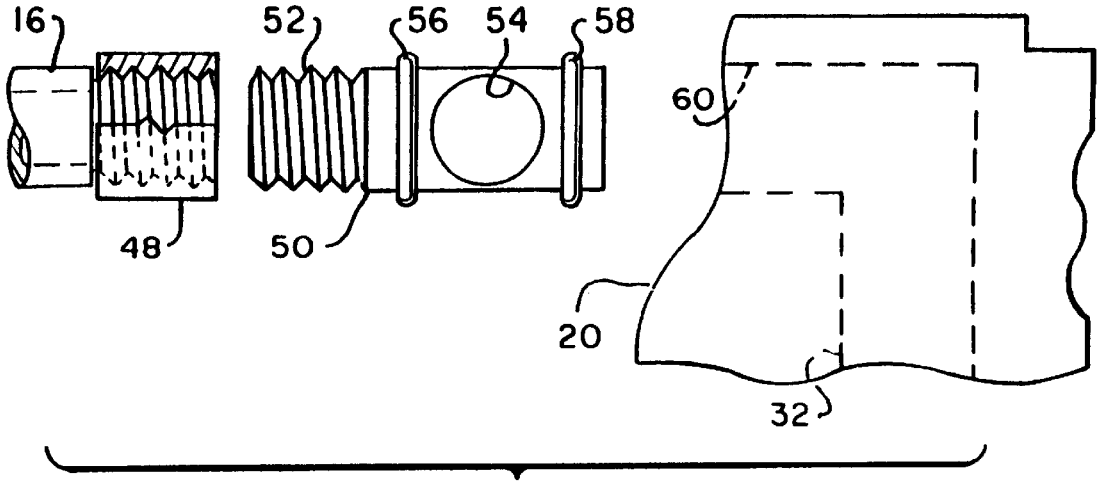
FIG. 4 is an enlarged partially sectional view of rotatable seat fittings via which foul/fresh air is passed from the seat to the filtration unit.

Reference is now made to FIG. 4 for the ensuing description of the details of the mounting means 36 and 38 as they relate to providing an air path from the flexible tubes to the first and second tubes within the seat. Since the mounting means 36 and 38 are identical only means 36 will be set forth in detail. Specifically, means 36 includes a nut 48 having internal threads which is secured onto the outer end of the flexible tube 16 (or 18). A hollow cylinder 50 has a threaded end portion 52 for threaded receipt within the nut 48. The cylinder opposite end portion has an opening 54 in the cylinder sidewall, and is further provided with O-rings 56 and 58 located, respectively, on the cylinder at opposite sides of the opening.

In assembly, each cylinder 50 is threaded into a respective nut 48 of tubes 16 and 18. The outer or opposite end of the cylinder 50 is pushed into an opening 60 that is located adjacent the rear of the seat 20, one on each side of the seat. When the cylinder 50 is fully received within opening 60 the tube 32 (and tube 34 as well) is in close air communication relation with opening 54 in the cylinder. Accordingly, on the unit fan being actuated, foul air is sucked from toilet bowl via means 22, filtered and fresh air blown out into the toilet bowl via means 24 to enhance foul air removal.

Figure 5:
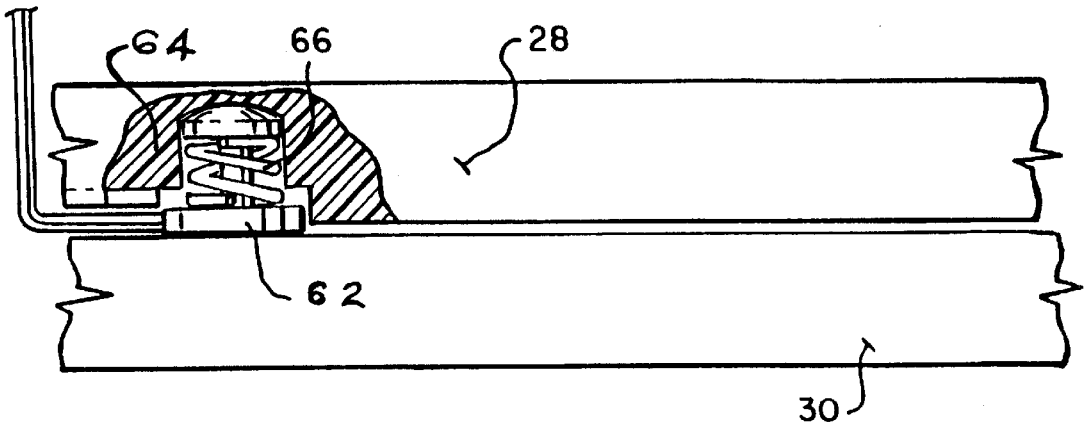
FIG. 5 is an elevational view of a further embodiment of the invention.

Although an electrical switch for energizing the fan can be located anywhere convenient, it is preferred that a pushbutton switch 62 be mounted to an upper surface of the upper seat part 28 (FIG. 5) and covered over by a resilient layer 64. When someone sits on the seat the pushbutton switch is actuated by the weight of the individual automatically energizing the fan, and thus the filtering action. On the individual's weight being removed from the seat a spring 66 automatically returns the switch to the open position stopping filtering action.

Figure 6:
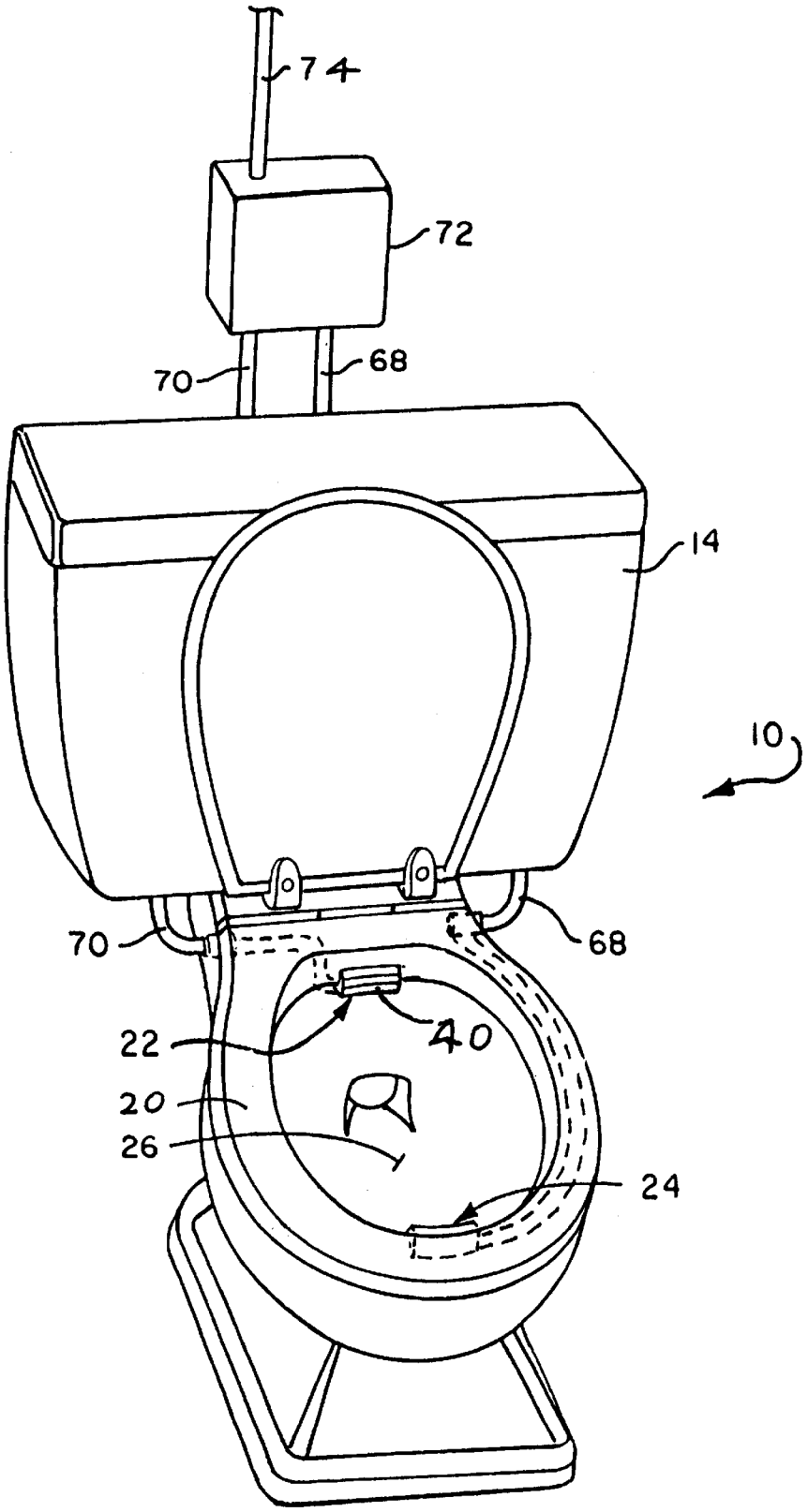
FIG. 6 is a perspective view of yet another embodiment of the invention.

For the ensuing description of yet another embodiment, reference is made to FIG. 6. As shown, the special seat 20 of the first described version interconnects via flexible tubes 68 and 70 with an electric fan air pressurizing means 72. The means 72 when energized takes foul air from inlet means 22 and moves it via a conduit 74 to an exit point located exteriorly of the bathroom. At the same time, the means 72 moves fresh air through flexible tube 68 for release at outlet means 24.

Although the present invention has been described in connection with a preferred embodiment, it is understood that those skilled in the appertaining art may contemplate making changes which come within the spirit of the invention as disclosed and encompassed by the appended claims.

What is claimed is:

1. Foul air removal apparatus for a toilet, comprising;

a toilet seat;

a foul air inlet means mounted to a first end portion of the toilet seat;

means interconnecting the seat and first end portion, enabling rotation of the seat about the seat first end portion;

air filtration means having pressurized air inlet and outlet;

a first flexible tube interconnecting the foul air inlet means with the filtration means pressurized air inlet;

fresh air outlet means mounted to a second end portion of the seat; and a second flexible tube interconnecting the filtration means pressurized air outlet with the fresh air outlet means; in which the seat includes first and second parts unitarily secured together; a first tubular member having one end connected to the foul air inlet means and its other end connected to the first flexible tube; a second tubular member having one end connected to the fresh air outlet means and its other end connected to the second flexible tube; and the first and second tubular members are secured between the first and second seat parts.

2. Foul air removal apparatus for a toilet, comprising;

a toilet seat;

a foul air inlet means mounted to a first end portion of the toilet seat;

means for interconnecting the seat and first end portion, enabling rotating of the seat about the seat first end portion; a threaded nut received on an end of each flexible tube; a hollow cylinder having a first threaded end received within the nut; an opening in the seat communicating with one of the flexible tubes and receiving the cylinder other end therein; and an O-ring received on said cylinder other end for sealing against air passage around the cylinder outer surface;

air filtration means having pressurized air inlet and outlet;

a first flexible tube interconnecting the foul air inlet means with the filtration means pressurized air inlet;

fresh air outlet means mounted to a second end portion of the seat; and a second flexible tube interconnecting the filtration means pressurized air outlet with the fresh air outlet means.

* * * * *